US010869132B2

(12) United States Patent
Zhang

(10) Patent No.: US 10,869,132 B2
(45) Date of Patent: Dec. 15, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,065

(22) Filed: Jul. 28, 2019

(65) Prior Publication Data

US 2020/0045436 A1 Feb. 6, 2020

(30) Foreign Application Priority Data

Aug. 5, 2018 (CN) ..... 2018 2 1261990 U

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2400/11* (2013.01); *H04R 2499/11* (2013.01)

(58) Field of Classification Search
CPC ..... H04R 9/025; H04R 9/06; H04R 15/00; H04R 9/02
USPC ..... 381/398, 400, 403, 412, 413
See application file for complete search history.

(56) References Cited

U.S. PATENT DOCUMENTS 8,300,876 B2 * 10/2012 Xu ..... H04R 31/006 381/433
2011/0255734 A1 * 10/2011 Marugami ..... H04R 9/025 381/398
2013/0279737 A1 * 10/2013 Jiang ..... H04R 9/025 381/412
2014/0376766 A1 * 12/2014 Chen ..... H04R 1/06 381/400

* cited by examiner

*Primary Examiner* — Fan S Tsang
*Assistant Examiner* — Julie X Dang
(74) *Attorney, Agent, or Firm* — W&G Law Group LLP

(57) ABSTRACT

The present disclosure provides a speaker, including a vibration unit, a magnetic circuit unit for driving the vibration unit to vibrate and emit sound, and a holder for fixing the magnetic circuit unit. The magnetic circuit unit includes a magnetic frame fixed in the holder and a magnet received in the magnetic frame. the magnetic frame includes a bottom wall connected to the magnet, a sidewall extending from the bottom wall while being bent towards the vibration unit, a positioning boss that is formed by die molding from the sidewall, protrudes out of the sidewall and is close to the holder, and a recess formed by recessing from a surface of the sidewall facing the magnet in a direction facing away from the magnet. The recess corresponds to the positioning boss. A size of the recess gradually decreases along a direction facing away from the magnet.

6 Claims, 5 Drawing Sheets

A–A

SPEAKER

TECHNICAL FIELD

The present disclosure relates to the field of acoustic-electrical conversion, and in particular, to a speaker used in portable electronic products.

BACKGROUND

With the advent of the mobile Internet era, the number of smart mobile devices continues to rise. Among the numerous mobile devices, mobile phones are undoubtedly the most common and portable mobile terminal devices. At present, functions of the mobile phones are extremely diverse, one of which is high-quality music. Therefore, speakers for playing sound are widely used in today's smart mobile devices.

A speaker in the related art includes a holder and a magnetic circuit unit and a vibration unit that are received in the holder. The magnetic circuit unit is used to drive the vibration unit to vibrate and emit sound and includes a magnetic frame and a magnet that is mounted on the magnetic frame and forming a magnetic gap with the magnetic frame. The vibration unit includes a diaphragm used to vibrate and emit sound and a voice coil having one end connected to the diaphragm and the other end inserted into the magnetic gap. By applying a current to the voice coil, the voice coil vibrates by being subjected to the Lorentz force in the magnetic field, and drives the diaphragm to vibrate and emit sound.

However, the speaker in the related art does not have any positioning structure on the magnetic frame, so that it is uneasy to determine a position of the magnetic frame during assembly. Once the assembling position of the magnetic frame is deviated, a relative position between the magnet and the voice coil will change, thereby affecting the sound emission effect of the speaker. Moreover, when extruding the positioning structure on the magnetic frame, a corresponding recess will be formed inside the magnetic frame. When the recess formed on the magnetic frame has the same shape as that of the positioning structure, a distance between a surface of the recess and a surface of the positioning structure is too close, thereby affecting the strength of the positioning structure.

Therefore, it is necessary to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
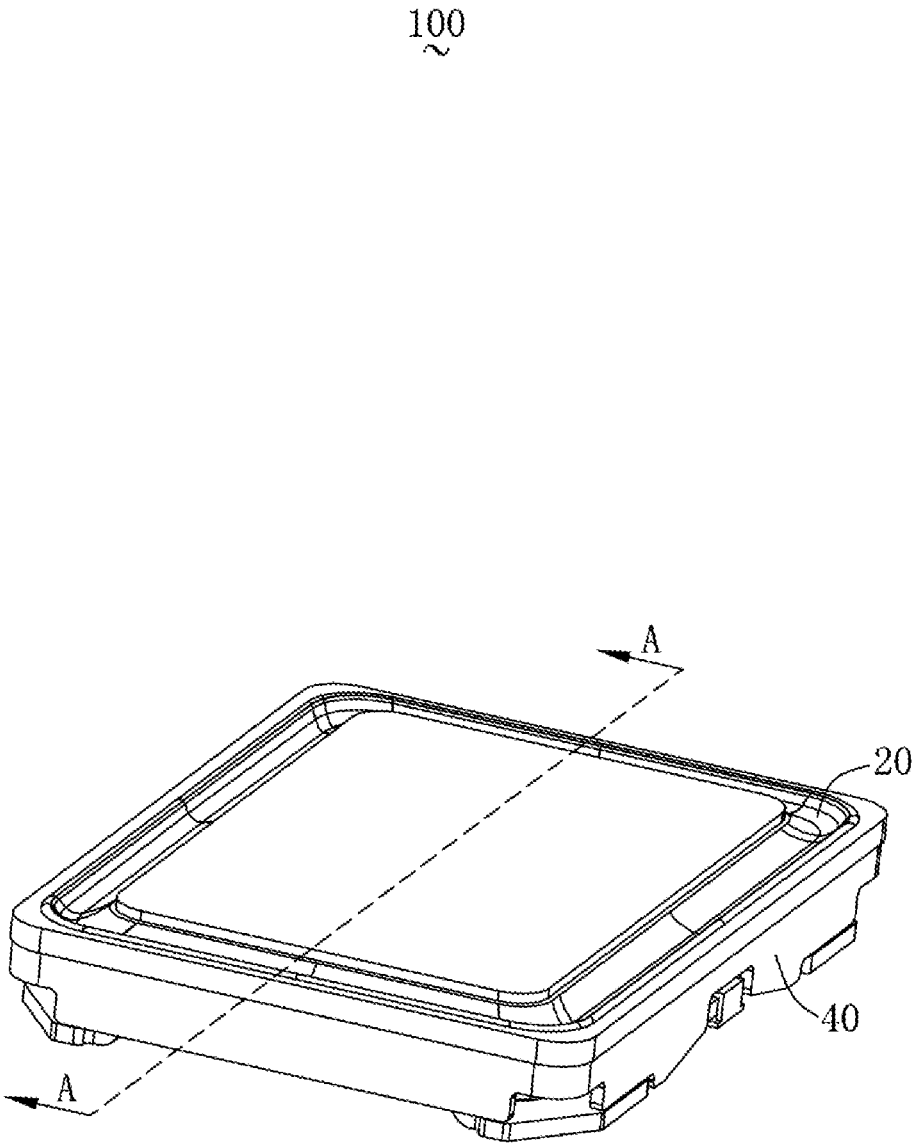
FIG. 1 is a perspective structural schematic diagram of a speaker of the present disclosure.
Figure 2:
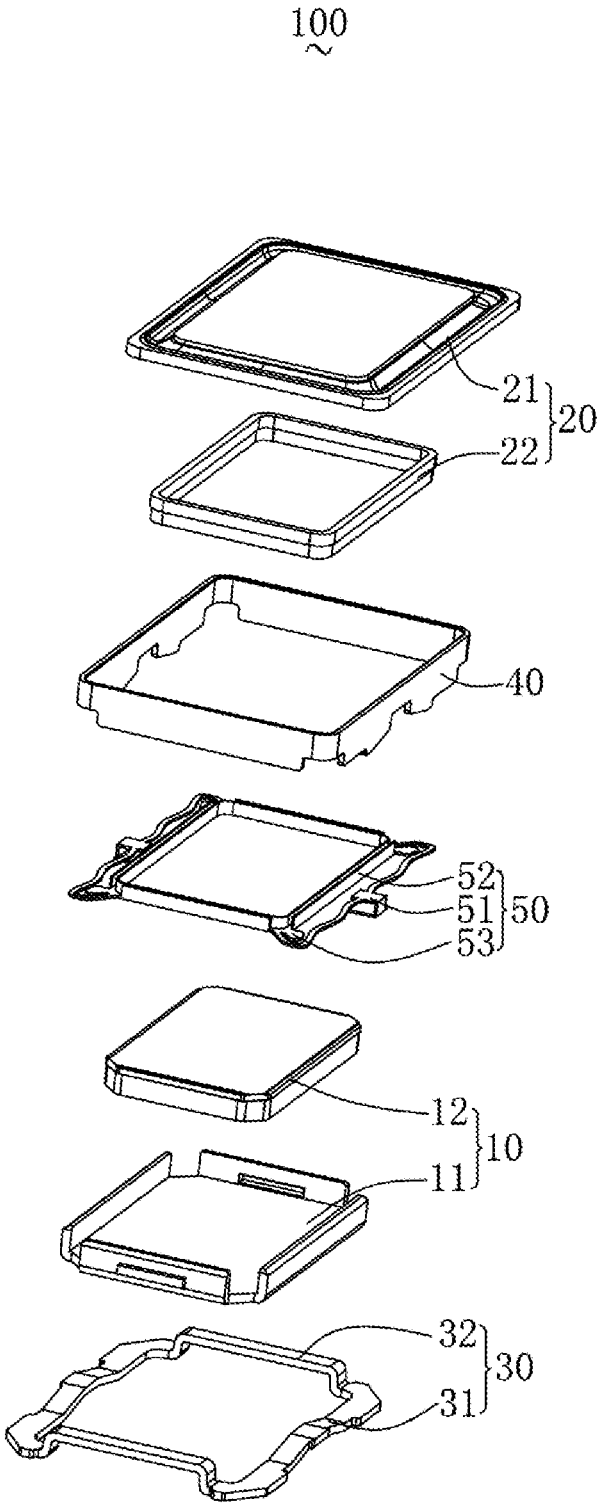
FIG. 2 is an exploded structural schematic diagram of a speaker of the present disclosure.

Referring to FIG. 1 and FIG. 2, the present disclosure provides a speaker 100. The speaker 100 includes a magnetic circuit unit 10, a vibration unit 20, a holder 30 that fixes the magnetic circuit unit 10, a frame body 40 that fixes the vibration unit 20, and a flexible printed circuit board 50 that is connected to the vibration unit 20. The magnetic circuit unit 10 is used to drive the vibration unit 20 to vibrate and emit sound, and the frame body 40 is sleeved and fixed to an outer side of the holder 30.

The magnetic circuit unit 10 includes a magnetic frame 11 fixed to the holder 30 and a magnet 12 provided in the magnetic frame 11.

Figure 3:
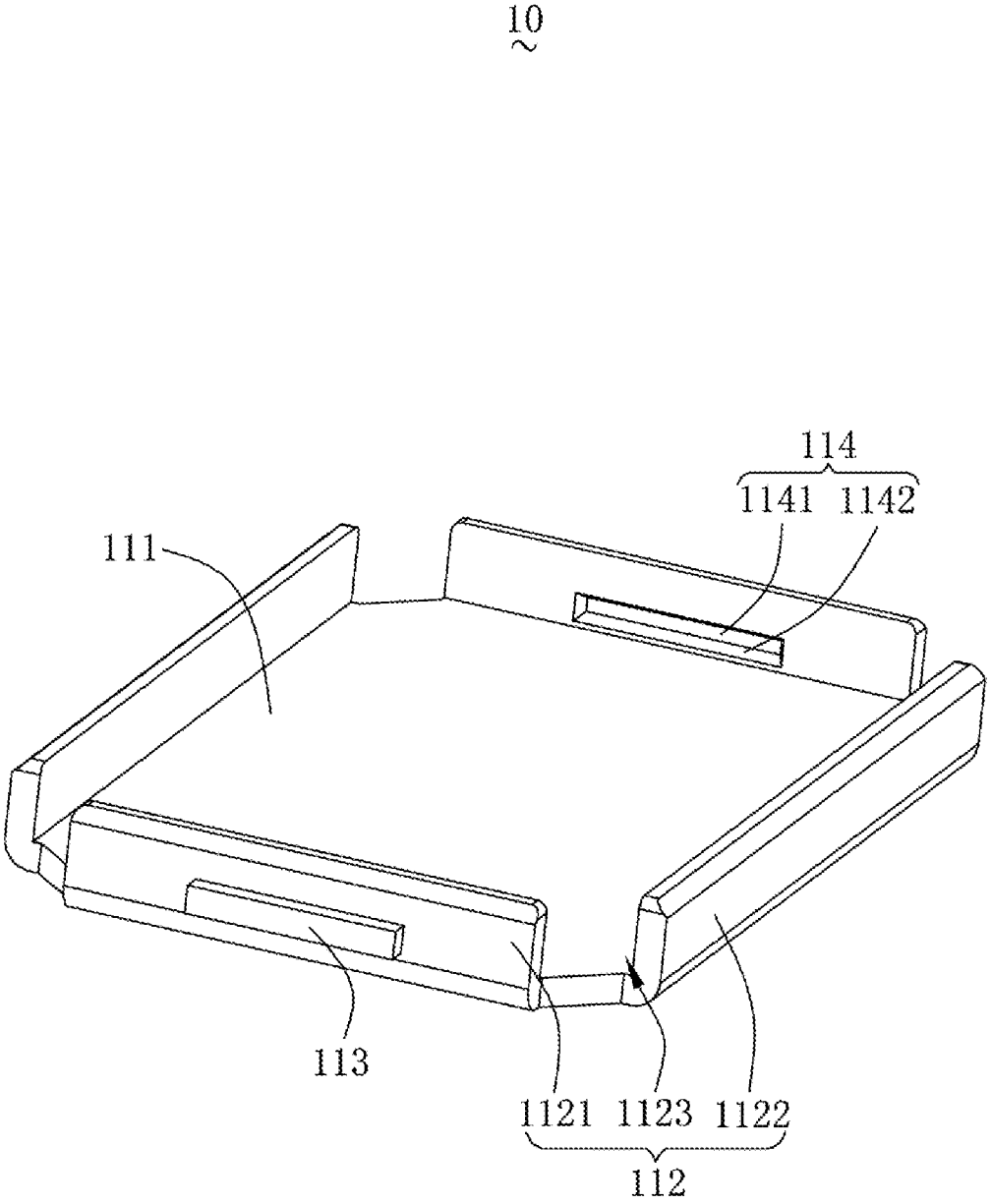
FIG. 3 is a perspective structural schematic diagram of a magnetic frame shown in FIG. 2.
Figure 4:
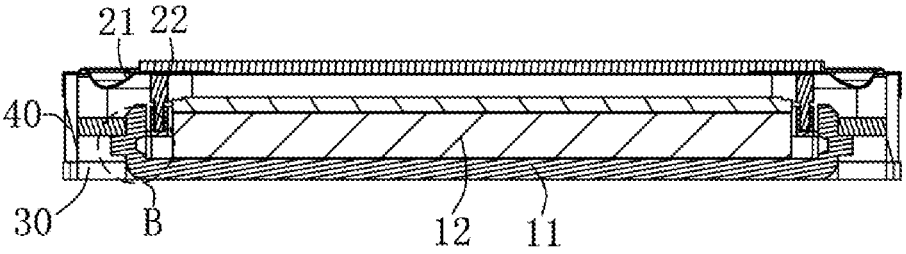
FIG. 4 is a cross-sectional diagram taken along line A-A of FIG. 1.
Figure 5:
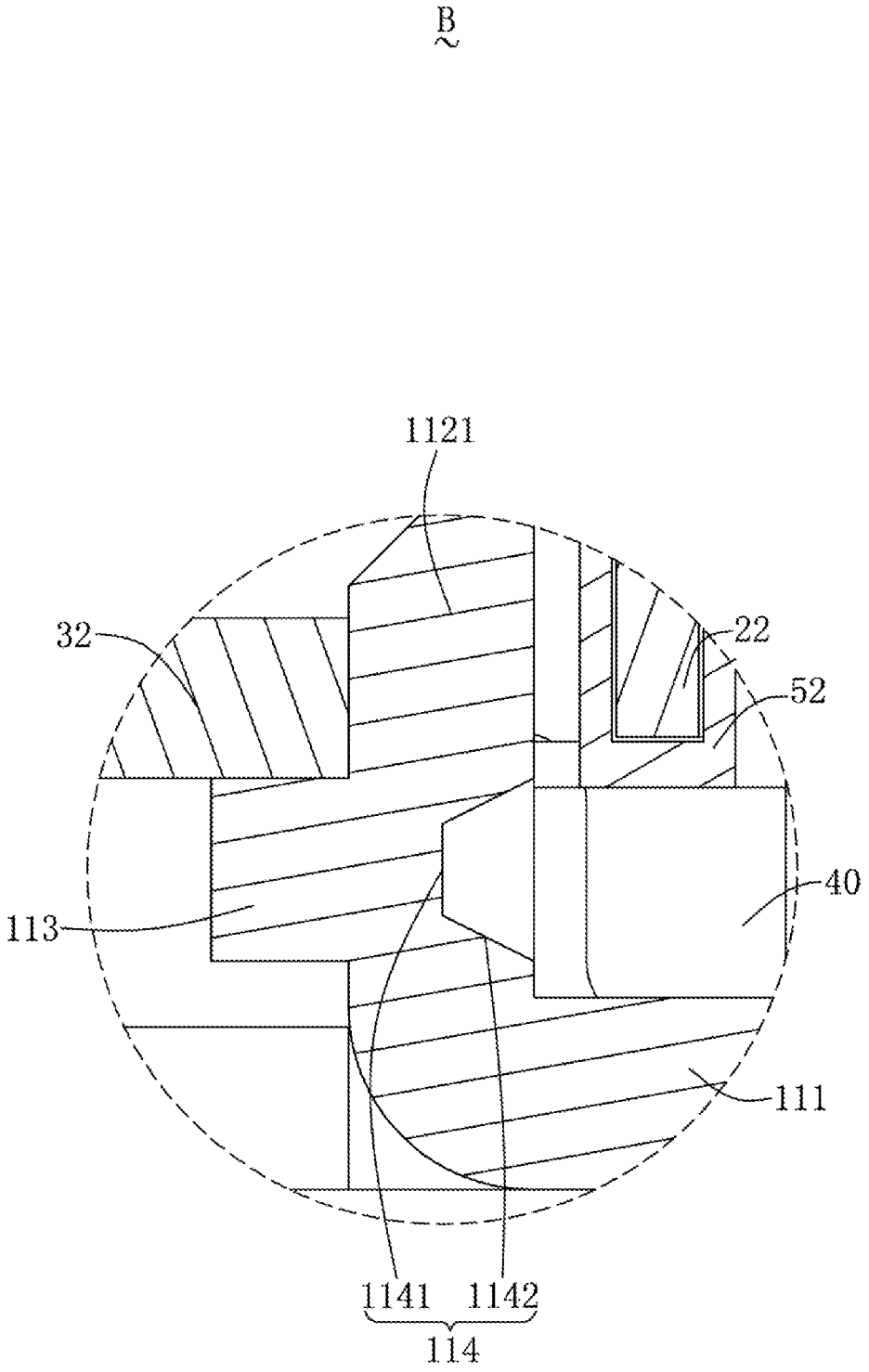
FIG. 5 is an enlarged partial diagram of a region B shown in FIG. 4.

Referring to FIG. 3 to FIG. 5 in conjunction, the magnetic frame 11 includes a bottom wall 111 connected to the magnet 12, a sidewall 112 extending from the bottom wall 111 while being bent towards the vibration unit 20, a positioning boss 113 that is formed by die molding from the sidewall 112, protrudes out of the sidewall 112 and is close to a side of the holder 30, and a recess 114 formed by recessing from a surface of the sidewall 112 close to the magnet 12 in a direction facing away from the magnet 12. The recess 114 corresponds to the positioning boss 113, and the sidewall 112 is spaced apart from the magnet 12 to form a magnetic gap.

The sidewall 112 includes a pair of short sidewalls 1121 arranged opposite to each other, a pair of long sidewalls 1122 connecting the two short sidewalls 1121, and four notches 1123 located between the adjacent short sidewall 1121 and long sidewall 1122.

The positioning boss 113 is positioned to be close to a side of the holder 30, and the recess 114 is positioned to be away from a side of the holder 30. The recess 114 is arranged right opposite to the positioning boss 113, i.e., the positioning boss 113 is a convex structure formed by extending from an outer side of the sidewall 112 and the recess 114 is a recessed structure formed by recessing from an inner side of the sidewall 112.

A cross-sectional area of the recess 114 gradually decreases as it gets closer to the positioning boss 113, i.e., a size of the recess 114 gradually decreases along the direction facing away from the magnet 12. Specifically, the recess 114 has a prism shape. By arranging the recesses 114 in a prism shape, surfaces constituting the recess 114 are all arranged in an inclined way and are all inclined towards a center of the positioning boss 113. Since the surfaces constituting the recess 114 are all inclined towards the center of the positioning boss 113, a distance between these surfaces and a side surface closest to the positioning boss 113 will be increased, such that a wall thickness between the recess 114 and the positioning boss 113 is increased, thereby increasing the structural strength of the positioning boss 113.

The recess 114 includes a recess bottom wall 1141 facing right towards the magnet 12 and recess sidewalls 1142 extending respectively from the opposite sides of the recess bottom wall 1141 towards the magnet 12. The recess sidewalls 1142 are symmetrically provided on two sides of the recess bottom wall 1141.

A distance between an end of the positioning boss 113 facing away from the sidewall 112 and the recess bottom wall 1141 is greater than a wall thickness of the sidewall 112. The maximum distance between the recess sidewalls 1142 is smaller than or equal to a thickness of the positioning boss 113 in a direction in which the vibration unit 20 vibrates. In the present embodiment, the maximum distance between the recess sidewalls 1142 is equal to the thickness of the positioning boss 113 in the direction in which the vibration unit 20 vibrates.

Preferably, the recess 114 has a positive prism shape.

There are two positioning bosses 113 and two recesses 114 provided respectively. The two positioning bosses 113 are respectively located on the two short sidewalls 1121 and symmetrically arranged. The two recesses 114 are respectively provided to correspond to the two positioning bosses 113. Specifically, the positioning boss 113 and the recess 114 are located at a middle position of the short sidewall 1121.

It can be understood that the installation difficulty of the magnetic frame 11 is reduced by providing the positioning boss 113, so that it is not easy for the magnetic frame 11 to have deviation when it is mounted on the holder 30. Moreover, the position of the magnetic frame 11 in the direction in which the vibration unit 20 vibrates can be adjusted by changing the position of the positioning boss 113 on the sidewall 112. In addition, the stability of the connection between the magnetic frame 11 and the holder 30 is also increased by providing the positioning boss 113.

The vibration unit 20 includes a diaphragm 21 used to vibrate and emit sound and a voice coil 22 for driving the diaphragm 21 to vibrate. The diaphragm 21 is fixedly connected to the frame body 40, and the voice coil 22 is inserted into the magnetic gap.

The holder 30 is fixedly connected to the frame body 40 and provided on a side of the frame body 40 facing away from the vibration unit 20. The holder 30 includes two long axis sides 31 and two short axis sides 32 connecting the two long axis sides 31. The two short axis sides 32 respectively abut against the side of the two positioning bosses 113 close to the diaphragm 21, i.e., the positioning boss 113 abuts against the side of the short axis side 32 facing away from the diaphragm 21.

Specifically, the long axis side 31 and the short axis side 32 are located on different planes. In this embodiment, along a direction from the bottom wall 111 to the diaphragm 21, the short axis side 32 is provided above the long axis side 31. Specifically, a distance between the vibration unit 20 and a side of the short axis side 32 close to the positioning boss 113 is smaller than a distance between the vibration unit 20 and the long axis side 31.

The frame body 40 has a rectangular ring structure.

The flexible printed circuit board 50 is connected to the voice coil 22 for communicating the voice coil 22 with an external circuit.

The flexible printed circuit board 50 is received in space enclosed by the frame body 40 and the holder 30 and abuts against the holder 30.

The flexible printed circuit board 50 includes an elastic arm 51 that abuts against the holder 30, a fixing portion 52 that is fixedly connected to the voice coil 22, and a connecting portion 53 that connects the elastic arm 51 with the fixing portion 52. There are four connecting portions 53 respectively connecting the elastic arm 51 with the fixing portion 52 through the four notches 1123.

Compared with the related art, the speaker provided by the present disclosure forms the positioning boss and the recess on the sidewall of the magnetic frame by die molding. The size of the recess gradually decreases towards a direction facing away from the magnet, thereby increasing the structural strength of the positioning boss; moreover, when the speaker is being assembled, the mounting position of the magnetic frame is more easily determined due to the arrangement of the positioning boss, which reduces the installation difficulty of the magnetic frame so that it is not easy to have deviation in the installation position of the magnetic frame, thereby improving the sound emission effect of the speaker; and moreover, the position of the magnetic frame in the direction in which the vibration unit vibrates can be adjusted by adjusting the position of the positioning boss on the sidewall.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a vibration unit;

a magnetic circuit unit for driving the vibration unit to vibrate and emit sound; and a holder for fixing the magnetic circuit unit, wherein the magnetic circuit unit comprises a magnetic frame fixed in the holder and a magnet received in the magnetic frame, the magnetic frame comprises a bottom wall connected to the magnet, a sidewall formed by extending from the bottom wall and being bent towards the vibration unit, and a positioning boss and a recess formed by die molding the sidewall, the recess corresponds to the positioning boss, the positioning boss protrudes from an outer surface of the sidewall and is close to the holder, the positioning boss and the sidewall form a step for abutting against the holder, a recess recesses from an inner surface of the sidewall in a direction facing away from the magnet, the recess comprises a recess bottom wall facing the magnet and recess sidewalls extending respectively from opposite sides of the recess bottom wall towards the magnet, a size of the recess gradually decreases along a direction facing away from the magnet, a length of the recess bottom is smaller than that of the positioning boss along a vibrating direction of the vibration unit.

2. The speaker as described in claim 1, wherein the sidewall comprises a pair of short sidewalls arranged opposite to each other, a pair of long sidewalls connecting the two short sidewalls, and four notches located between each short sidewall and each of its adjacent long sidewalls, the positioning boss and the recess being formed on the short sidewalls by die molding.

3. The speaker as described in claim 2, wherein two positioning bosses and two recesses are provided respectively, the two positioning bosses being respectively located on the two short sidewalls and symmetrically arranged and the two recesses being respectively provided to correspond to the two positioning bosses.

4. The speaker as described in claim 1, wherein the holder comprises two long-axis sides and two short-axis sides connecting the two long-axis sides, the positioning boss abutting against a side of one of the two short-axis sides facing away from the vibration unit.

5. The speaker as described in claim 4, wherein the two long-axis sides and the two short-axis side are located on different planes, a distance between a side of one of the two short-axis sides close to the positioning boss and the vibration unit being smaller than a distance between a side of one of the two long-axis sides close to the positioning boss and the vibration unit.

6. The speaker as described in claim 1, wherein a distance between one end of the positioning boss facing away from the sidewall and the recess bottom wall is greater than a wall thickness of the sidewall.

* * * * *